US009266587B1

(12) United States Patent
Vandenworm

(10) Patent No.: US 9,266,587 B1
(45) Date of Patent: Feb. 23, 2016

(54) FLOATING VESSEL

(71) Applicant: JURONG SHIPYARD PTE LTD., Singapore (SG)

(72) Inventor: Nicolaas Johannes Vandenworm, Houston, TX (US)

(73) Assignee: JURONG SHIPYARD PTE LTD., Singapore (SG)

( * ) Notice: Subject to any disclaimer, the term of this patent is extended or adjusted under 35 U.S.C. 154(b) by 0 days.

(21) Appl. No.: 14/630,563

(22) Filed: Feb. 24, 2015

Related U.S. Application Data

(63) Continuation-in-part of application No. 14/524,992, filed on Oct. 27, 2014, which is a continuation-in-part of application No. 14/105,321, filed on Dec. 13, 2013, now Pat. No. 8,869,727, which is a continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/521,701, filed on Aug. 9, 2011, provisional application No. 61/259,201, filed on Nov. 8, 2009, provisional application No. 61/262,533, filed on Nov. 18, 2009.

(51) Int. Cl.

| | |
|---|---|
| ***B63B 35/44*** | (2006.01) |
| ***B63B 21/04*** | (2006.01) |
| ***E21B 17/01*** | (2006.01) |
| *B63B 3/14* | (2006.01) |

(52) U.S. Cl.
CPC ..... *B63B 35/4413* (2013.01); *B63B 21/04* (2013.01); *E21B 17/01* (2013.01); *B63B 2003/147* (2013.01); *B63B 2035/448* (2013.01); *B63B 2035/4473* (2013.01)

(58) Field of Classification Search
USPC ..... 114/264, 125
IPC ..... B63B 35/4413
See application file for complete search history.

(56) References Cited

U.S. PATENT DOCUMENTS

| | | | |
|---|---|---|---|
| 2,156,635 | A | 5/1939 | Mascuch et al. |
| 3,041,639 | A | 7/1962 | Atlas |
| 4,282,822 | A | 8/1981 | Jackson |
| 4,446,808 | A | 5/1984 | Colin |
| 4,549,835 | A | 10/1985 | Ando et al. |
| 4,640,214 | A | 2/1987 | Bruns |

(Continued)

FOREIGN PATENT DOCUMENTS

WO 2009136799 A1 11/2009

*Primary Examiner* — Stephen Avila
(74) *Attorney, Agent, or Firm* — Buskop Law Group, PC; Wendy Buskop

(57) ABSTRACT

A floating vessel configured to support at least one of: drilling of wells, workover of wells, production, and storage of hydrocarbons, and personnel accommodation, having a hull. The hull has a bottom surface, a top deck surface, and at least two connected sections engaging between the bottom surface and the top deck surface. The at least two connected sections are joined in a series and symmetrical about a vertical axis. The connected sections extend downwardly from the top deck surface toward the bottom surface. The connected sections can have an upper cylindrical portion, a neck section, and a lower conical section. At least one fin is secured to the hull and the lower conical section provides added mass improved hydrodynamic performance through linear and quadratic damping to the hull.

8 Claims, 7 Drawing Sheets

(56) References Cited

U.S. PATENT DOCUMENTS

| | | | | |
|---|---|---|---|---|
| 4,679,517 | A | 7/1987 | Kramer | |
| 4,984,935 | A | 1/1991 | de Oliveira Filho et al. | |
| 5,065,687 | A | 11/1991 | Hampton | |
| 5,573,353 | A | 11/1996 | Recalde | |
| 6,663,320 | B1 * | 12/2003 | Braud et al. | 405/224 |
| 6,761,508 | B1 | 7/2004 | Haun | |
| 6,945,736 | B2 | 9/2005 | Smedal et al. | |
| 7,958,835 | B2 | 6/2011 | Srinivasan | |
| 8,251,003 | B2 | 8/2012 | Vandenworm | |
| 8,662,000 | B2 | 3/2014 | Vandenworm | |
| 2009/0126616 | A1 * | 5/2009 | Srinivasan | 114/264 |
| 2013/0133563 | A1 | 5/2013 | Kroecker | |
| 2014/0290553 | A1 | 10/2014 | Syvertsen et al. | |

* cited by examiner

FIGURE 4
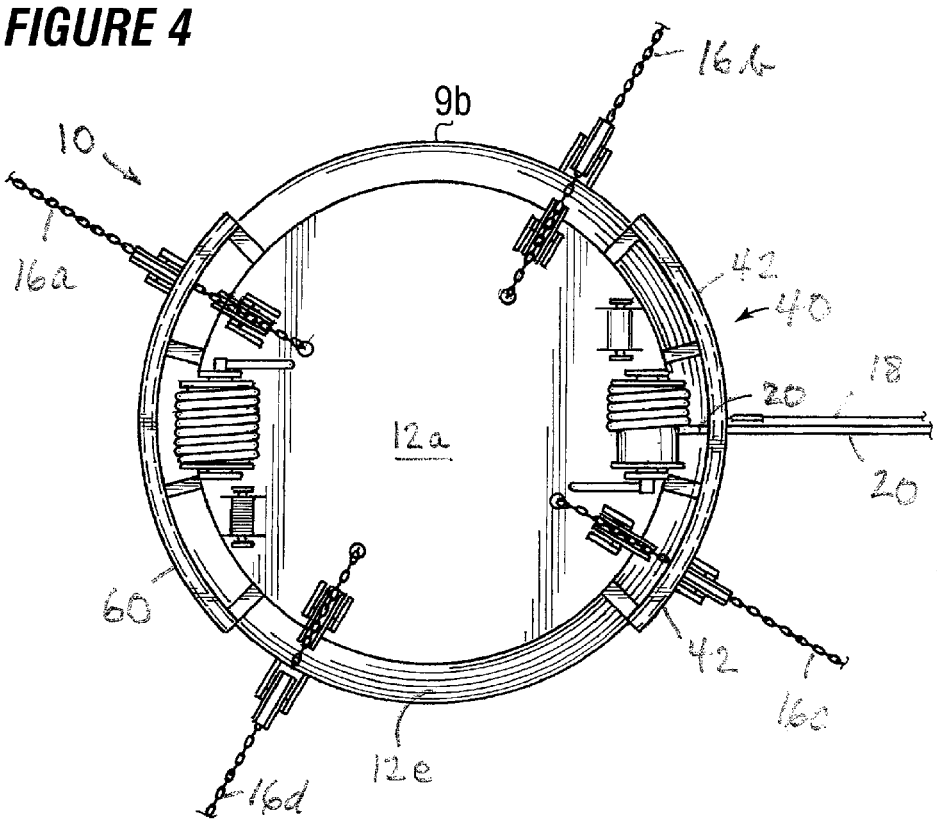
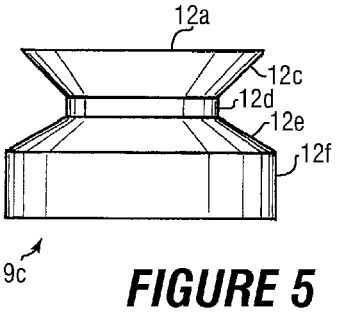
FIGURE 5
FIGURE 6
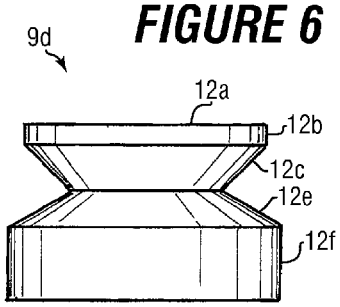

FLOATING VESSEL

CROSS REFERENCE TO RELATED APPLICATIONS

The present application is a Continuation in Part of co-pending U.S. patent application Ser. No. 14/524,992 filed on Oct. 27, 2014, entitled "BUOYANT STRUCTURE," which is a Continuation in Part of U.S. patent application Ser. No. 14/105,321 filed on Dec. 13, 2013, entitled "FLOATING VESSEL," now issued as U.S. Pat. No. 8,869,727 on Oct. 28, 2014, which is a Continuation in Part of U.S. patent application Ser. No. 13/369,600 filed on Feb. 9, 2012, entitled "STABLE OFFSHORE FLOATING DEPOT," now issued as U.S. Pat. No. 8,662,000 on Mar. 4, 2014, which is a Continuation in Part of U.S. patent application Ser. No. 12/914,709 filed on Oct. 28, 2010, now issued as U.S. Pat. No. 8,251,003 on Aug. 28, 2012, which claims the benefit of U.S. Provisional Patent Application Ser. No. 61/521,701 filed on Aug. 9, 2011, U.S. Provisional Patent Application Ser. No. 61/259,201 filed on Nov. 8, 2009 and U.S. Provisional Patent Application Ser. No. 61/262,533 filed on Nov. 18, 2009. These references are hereby incorporated in their entirety.

FIELD

The present embodiments generally relate to floating production, storage and offloading (FPSO) vessels and to hull designs and offloading systems for a floating drilling, production, storage and offloading (FDPSO) vessel.

BACKGROUND

Prior art relevant to the present invention and provides the following background information concerning the development of offshore energy systems such as deepwater oil and/or gas production. Long flowlines, power cables, and control umbilicals are frequently required between subsea wells and a host platform. The extended lengths pose energy loss, pressure drop, and production difficulties. The costs of structures for deepwater applications are high and costs frequently increase due to the foreign locations at which they are fabricated.

Other difficulties, associated with deepwater offshore operations, result from floating vessel motions which affect personnel and efficiencies especially when related to liquid dynamics in tanks. The primary motion-related problem, associated with offshore petrochemical operations, occurs with large horizontal vessels in which the liquid level oscillates and provides erroneous signals to the liquid level instruments causing shutdown of processing and overall inefficiency for the operation.

The principal elements which can be modified for improving the motion characteristics of a moored floating vessel are the draft, the water plane area, and its draft rate of change, location of the center of gravity (CG), the metacentric height about which small amplitude roll and pitching motions occur, the frontal area and shape on which winds, current and waves act, the system response of pipe and cables contacting the seabed acting as mooring elements, and the hydrodynamic parameters of added mass and damping. The latter values can be determined by complex solutions of the potential flow equations integrated over the floating vessels detailed features and appendages and then simultaneously solved for the potential source strengths. It is only significant to note herein that the addition of features which allow the added mass and/or damping to be "tuned" for a certain condition requires that several features can be modified in combination, or more preferably independently, to provide the desired properties. The optimization can be greatly simplified if the vessel possesses vertical axial symmetry as in the present invention which reduces the 6 degrees of motion freedom to 4, (i.e. roll=pitch=pendular motion, sway=surge=lateral motion, yaw=rotational motion, and heave=vertical motion). It can be further simplified if hydrodynamic design features can be de-coupled to linearize the process and ease the ideal solution search.

The prior art provides for an offshore floating facility with improved hydrodynamic characteristics and the ability to moor in extended depths thereby providing a satellite platform in deep water resulting in shorter flowline, cables, and umbilicals from the subsea trees to the platform facilities. Previous designs incorporate a retractable center assembly which contains features to enhance the hydrodynamics and allows for the integral use of vertical separators in a quantity and size providing opportunity for individual full time well flow monitoring and extending retention times.

A principal feature of vessels of the industry is a retractable center assembly within the hull, which can be raised or lowered in the field to allow transit in shallow areas. The retractable center assembly provides a means of pitch motion damping, a large volumetric space for the incorporation of optional ballast, storage, vertical pressure or storage vessels, or a centrally located moon pool for deploying diving or remote operated vehicle (ROV) video operations without the need for added support vessels.

Hydrodynamic motion improvements of vessels are provided by: the basic hull configuration; extended skirt and radial fins at the hull base; a (lowered at site) center assembly extending the retractable center section with the base and mid-mounted hydrodynamic skirts and fins, the mass of the separators below the hull deck that lowers the center of gravity; and attachment of the steel catenary risers, cables, umbilicals, and mooring lines near the center of gravity at the hull base. The noted features improve vessel stability and provide increased added mass and damping, which improves the overall response of the system under environmental loading.

Prior art vessels can have hulls which are hexagonal in shape. Floating production, storage and offloading vessel can have an octagonal hull. Prior art floating production, storage, and offloading vessels have a polygonal exterior side wall configuration with sharp corners to cut ice sheets, resist and break ice, and move ice pressure ridges away from the vessel. Prior art also teaches a drilling and production platform consisting of a semi-submersible platform body having the shape of a cylinder having a flat bottom and a circular cross-section. Previous vessels have a peripheral circular cut-out or recess in a lower part of the cylinder, and the design provides a reduction in pitching and rolling movement. Because floating production, storage and offloading vessels may be connected to production risers, and in general the need to be stable, even during storm conditions, remains a need for improvements in vessel hull design.

Further there is a need for improvement in offloading product from a floating production, storage and offloading vessel to a ship or tanker then transporting the product from the floating production, storage and offloading vessel to an onshore facility.

As part of an offloading system, a catenary anchor leg mooring (CALM) buoy, is typically anchored near a floating production, storage and offloading vessel. An example of a buoy usable with the offloading system, the buoy is anchored to the seabed so as to provide a minimum distance from a nearby floating production, storage and offloading vessel. In this example, a pair of cables attaches the buoy to the floating production, storage and offloading vessel and an offloading hose extends from the floating production, storage and offloading vessel to the buoy. A tanker is moored temporarily to the buoy and a hose is extended from the tanker to the buoy for receiving product from the floating production, storage and offloading vessel through hoses connected through the buoy. If adverse weather conditions, such as a storm with significant wind speeds occur during offloading, problems can occur due to movement of the tanker caused by wind and current forces acting on the tanker. Thus, there is also a need for an improvement in the offloading system typically used in transferring product stored on the floating production, storage and offloading vessel to a tanker.

A need exists for a floating vessel that provides kinetic energy absorption capabilities from a watercraft by providing a plurality of dynamic movable tendering mechanisms in a tunnel formed in the floating vessel.

A further need exists for a floating vessel that provides wave damping and wave breakup within a tunnel formed in the floating vessel.

A need exists for a floating vessel that provides friction forces to a hull of a watercraft in the tunnel.

The present embodiments meet these needs.

BRIEF DESCRIPTION OF THE DRAWINGS

The detailed description will be better understood in conjunction with the accompanying drawings as follows:

FIG. 4 depicts an enlarged and more detailed version of the top plan view of the floating production, storage and offloading vessel.

FIG. 5 depicts a side elevation of an alternative embodiment of the hull for floating production, storage and offloading vessel according to the present invention.

FIG. 6 depicts a side elevation of an alternative embodiment of the hull for a floating production, storage and offloading vessel, according to the present invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a floating platform, storage and offloading (FPSO) vessel with several alternative hull designs, and a moveable hawser system for offloading, which allows a tanker to weathervane over a wide arc with respect to the floating production, storage and offloading vessel.

The embodiments further relate to a floating vessel configured to support at least one of: drilling of wells, workover of wells, production of hydrocarbons, storage of hydrocarbons, and personnel accommodation.

In embodiments, the floating production, storage and offloading vessel can have a hull planform that can be circular, oval, elliptical, or polygonal.

In embodiments, the hull of the floating production, storage and offloading vessel can have a bottom surface (known as a keel); deck surface (also known as a main deck); at least two connected sections engaging between the bottom surface (keel) and the deck surface (main deck).

In embodiments, the at least two connected sections can be joined in series and each can be configured to be symmetrical about a vertical axis. The connected sections can extend downwardly from the deck surface toward the bottom surface.

In embodiments, the connected sections can have at least two of: an upper cylindrical portion; a cylindrical neck section; and a lower conical section.

In additional embodiments, at least one fin can be secured to the hull to reduce movement.

The lower conical section provides added mass improved hydrodynamic performance through linear and quadratic damping to the hull. The floating production, storage and offloading vessel specifically does not require a retractable center column to control pitch roll and heave.

Figure 1:
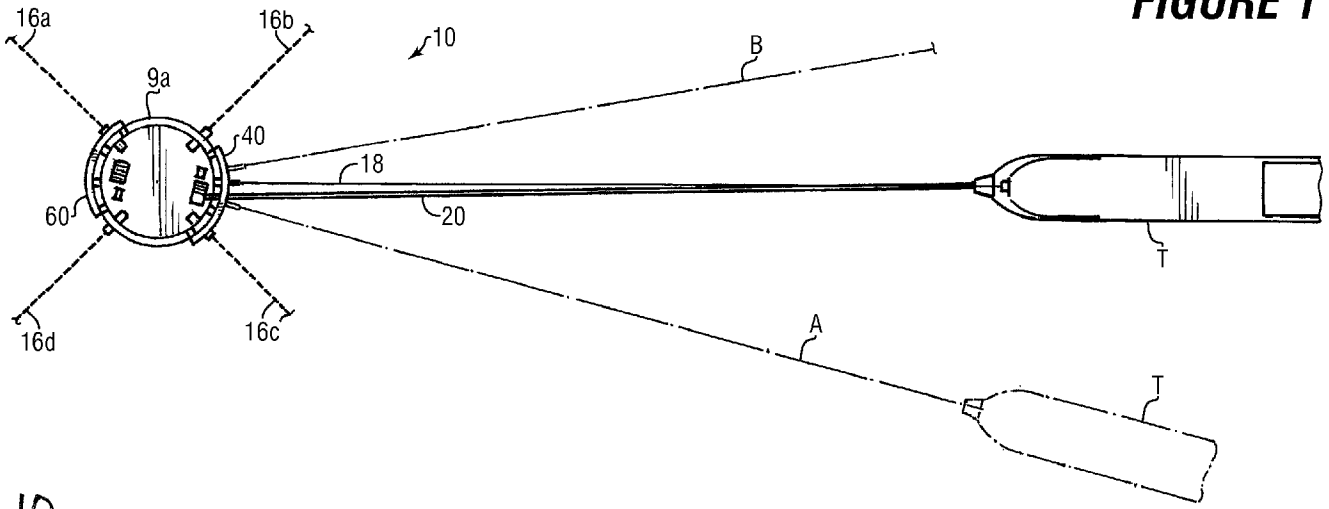
FIG. 1 depicts a top plan view of a floating production, storage and offloading vessel, according to the present invention and a tanker moored to the floating production, storage and offloading vessel.

Turning now to the Figures, FIG. 1 depicts a floating production, storage and offloading vessel 10 is shown in a plan view.

The tanker T is shown in two different positions A, and B, as the tanker weathervane on the floating production, storage and offloading vessel 10.

The floating production, storage and offloading vessel 10 can be a hull 9*a*. The floating production, storage and offloading vessel 10 floats in water W and can be used in the production, storage and/or offloading of resources extracted from the Earth, such as hydrocarbons including crude oil and natural gas and minerals such as can be extracted by solution mining. The floating production, storage and offloading vessel 10 can be assembled onshore using known methods, which can be similar to shipbuilding, and towed to an offshore location, typically above an oil and/or gas field in the earth below the offshore location. At least one anchor line 16*a*, 16*b*, 16*c*, and 16*d*, which would be fastened to anchors in the seabed that are not shown, moor floating production, storage and offloading vessel 10 in a desired location.

At least one moveable hawser assemblies 18 can be used. Each moveable hawser assembly can be disposed in a different location on the hull, namely as a moveable hawser connection assembly 40 and a moveable hawser assembly 60.

A hose 20 can be extended between hull 9*a* and tanker T for transferring crude oil and/or another fluid from floating production, storage and offloading vessel 10 to tanker T.

Figure 2:
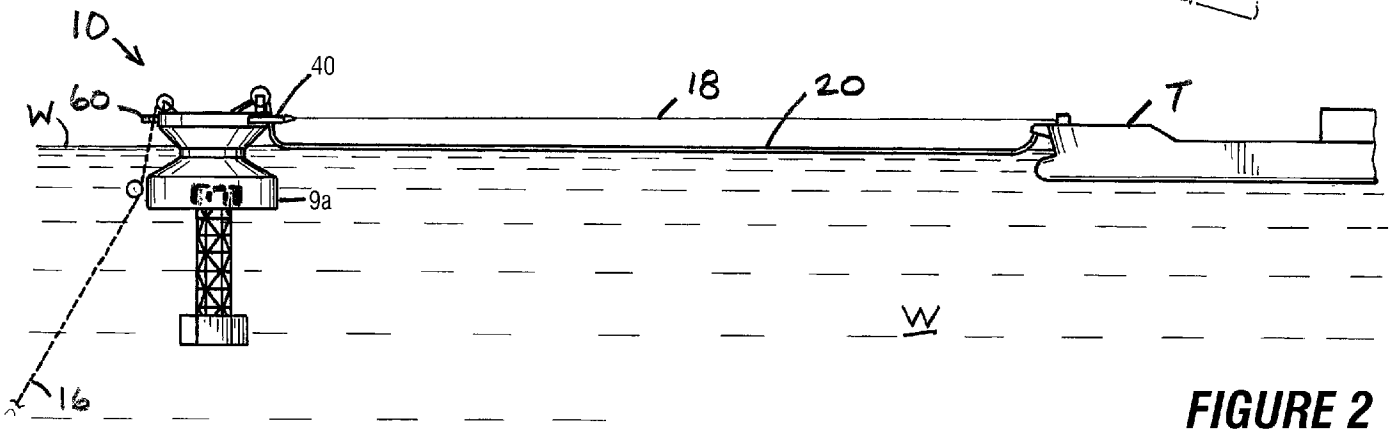
FIG. 2 depicts a side elevation of the floating production, storage and offloading vessel.

FIG. 2 depicts a side elevation of the floating production, storage and offloading vessel 10 according to the present invention.

In a typical application for floating production, storage and offloading vessel 10, crude oil can be produced from the Earth below the seabed under the floating production, storage and offloading vessel 10, transferred into and stored temporarily in the hull 9*a*, and offloaded to a tanker T for transport to onshore facilities. Tanker T can be moored temporarily to the floating production, storage and offloading vessel 10 during the offloading operation by the moveable hawser connection assembly 40. The hose 20 can be extended between the hull 9*a* and tanker T for transferring crude oil and/or another fluid from the floating production, storage and offloading vessel 10 to tanker T.

In embodiments, the at least one moveable hawser assemblies 18 can be used. Each moveable hawser assembly can be disposed in a different location on the hull 9*a*, namely as the moveable hawser connection assembly 40 and the moveable hawser assembly 60.

Figure 3:
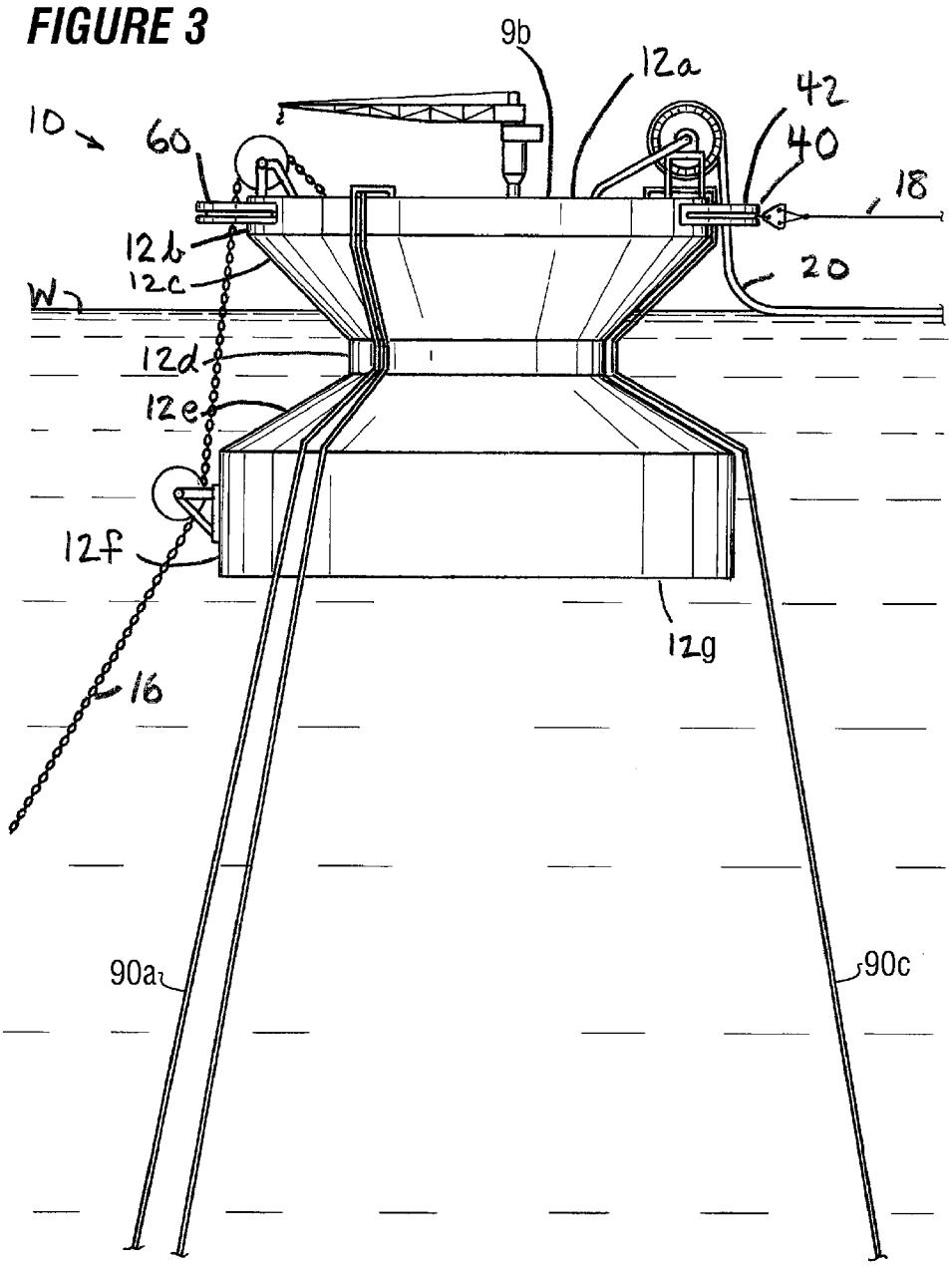
FIG. 3 depicts an enlarged and more detailed version of the side elevation of the floating production, storage and offloading vessel.

FIG. 3 is side elevation of floating production, storage and offloading vessel 10.

A hull 9*b* of the floating production, storage and offloading vessel 10 is shown having a top deck surface 12*a*, an upper cylindrical portion 12*b* extending downwardly from the deck surface 12*a*, an upper conical section 12*c* extending downwardly from upper cylindrical portion 12*b*, and tapering inwardly, a cylindrical neck section 12*d* extending downwardly from upper conical section 12*c*, a lower conical section 12*e* extending downwardly from cylindrical neck section 12*d* which can flare outwardly, and a lower cylindrical section 12*f* extending downwardly from the lower conical section 12*e*.

In embodiment, the lower conical section 12*e* can be described herein as having the shape of an inverted cone or as having an inverted conical shape as opposed to the upper conical section 12*c*, which can be described herein as having a regular conical shape. The floating production, storage and offloading vessel 10 floats such that the surface of the water intersects regular with the upper conical section 12*c*, which can be referred to herein as the waterline being on the regular cone shape.

In embodiments, the floating production, storage and offloading vessel 10 can be loaded and/or ballasted to maintain the waterline on a bottom portion of regular, upper conical section 12*c*. When the floating production, storage and offloading vessel 10 can be installed and float properly, a cross-section of the hull 9*b* through any horizontal plane can have a circular shape.

In embodiments, the hull 9*b* can be designed and sized to meet the requirements of a particular application, and services can be requested from Maritime Research Institute of the Netherlands to provide optimized design parameters to satisfy the design requirements for a particular application.

In this embodiment, the upper cylindrical portion 12*b* can have approximately the same height as the cylindrical neck section 12*d*, while the height of the lower cylindrical section 12*f* can be about 3 to 4 times greater than the height of the upper cylindrical portion 12*b*. The lower cylindrical section 12*f* can have a greater diameter than the upper cylindrical portion 12*b*. The upper conical section 12*c* can have a greater height than the lower conical section 12*e*. The bottom surface 12*g* is also depicted.

In this embodiment, a plurality of catenary production risers 90*a* and 90*c* are depicted. In embodiments, the plurality of catenary production risers can be at least one of: a catenary riser or a vertical riser production riser, or combinations thereof.

The hawser 18 of the moveable hawser connection assembly 40 and the moveable hawser assembly 60 are also depicted. A tubular channel 42 is also depicted.

In this embodiment, the hose 20 can be depicted on a hose reel. The hose can extend from the hull 9*b* and the tanker for transfer of crude oil and/or another fluid from floating production, storage and offloading vessel 10 to tanker.

In this embodiment the at least one anchor lines 16 is depicted.

FIG. 4 depicts the moveable hawser connection assembly 40 that has in one embodiment nearly fully enclosing the tubular channel 42. The tubular channel 42 can have a rectangular cross-section and a longitudinal slot.

In this Figure, the hull 9*b* of floating production, storage and offloading vessel 10 is shown with the top deck surface 12*a* and the lower conical section 12*e*.

The lower conical section 12*e* can be described herein as having the shape of an inverted cone or as having an inverted conical shape.

In this embodiment, the hawser 18 of the moveable hawser connection assembly 40. The moveable hawser assembly 60 is also depicted.

In embodiments, the hose 20 can be depicted on a hose reel; this can be the hose 20 that extends between the hull 9*b* and tanker for the transfer of crude oil and/or another fluid from the floating production, storage and offloading vessel 10 to tanker.

In this embodiment, the at least one anchor lines 16*a*, 16*b*, 16*c*, and 16*d* are depicted.

FIG. 5 depicts side elevations showing an alternative design for the hull 9*c*.

In embodiments, a hull 9*c* can have the top deck surface 12*a*, wherein the upper conical section 12*c* extends from the top deck surface 12*a* and tapers inwardly as it extends downwardly. The cylindrical neck section 12*d* which can be attached to a lower end of the upper conical section 12*c* and extend downwardly from the upper conical section. The lower conical section 12*e* can be attached to a lower end of the cylinder neck section 12*d* and extends downwardly from cylindrical neck section 12*d* while flaring outwardly. The lower cylindrical section 12*f* extends downwardly from the lower conical section 12*e*.

In further embodiments, a significant difference between the hull 9*c* and other hull designs can be that hull 9*c* does not have the upper cylindrical portion 12*b*.

FIG. 6 depicts side elevations showing an alternative design for the hull 9*d*.

A side elevation of a hull 9*d* which shows the hull 9*d* that can have the top deck surface 12*a*, the upper cylindrical portion 12*b*, the upper conical section 12*c* extending from the upper cylindrical portion 12*b* and taper inwardly as it extends downwardly.

In this embodiment, the lower conical section 12*e* can be attached to the upper conical section 12*c*. The lower conical section 12*e* can extend downwardly while flaring outwardly. The lower cylindrical section 12*f* extends downwardly from the lower conical section 12*e*.

In embodiments, a significant difference between the hull 9*d* and other hull designs can be that the hull 9*d* does not have the cylindrical neck section 12*d*.

Figure 7:
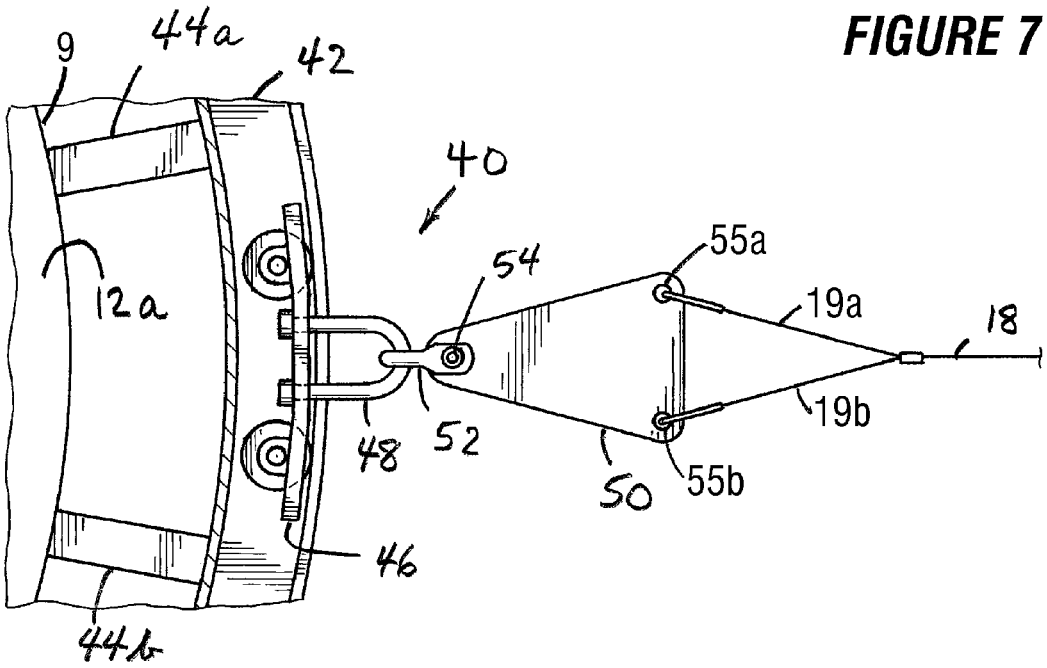
FIG. 7 depicts a top plan view of a moveable hawser connection, according to the present invention.

FIG. 7 is a top plan view of the moveable hawser connection assembly 40, according to the present invention.

In this embodiment, the moveable hawser connection assembly 40 is depicted on the floating production, storage and offloading vessel, which can help to accommodate movement of the transport tanker with respect to the floating production, storage and offloading vessel.

In embodiments, the moveable hawser connection assembly 40 comprises in one embodiment nearly fully enclosing the tubular channel 42 that has a rectangular cross-section and a longitudinal slot.

In this embodiment, the tubular channel 42 is shown with a set of standoffs 44*a* and 44*b* that can connect the tubular channel 42 horizontally to the top deck surface 12*a*. A trolley 46 can be captured and moveable within the tubular channel 42. A trolley shackle 48 can be attached to the trolley 46 providing a connection point and a plate 50 pivotably attaching to the trolley shackle 48 through a plate shackle 52.

In embodiments, the plate 50 can have a generally triangular shape with the apex of the triangle attached to the plate shackle 52 through a pin 54 passing through a hole in the plate shackle 52. The plate 50 can have a first hole 55*a* adjacent another point of the triangle and a second hole 55*b* adjacent the final point of the triangle. The hawser 18 terminates with a dual connection point 19*a* and 19*b* which can be connected to the plate 50 by passing through the holes 55*a* and 55*b* respectively.

In alternative embodiment, the dual connection point 19*a* and 19*b* of the plate 50 and or the plate shackle 52 can be eliminated and the hawser 18 can be connected directly to the trolley shackle 48. Other variations can be usable in connecting the hawser 18 to the trolley 46.

Figure 8:
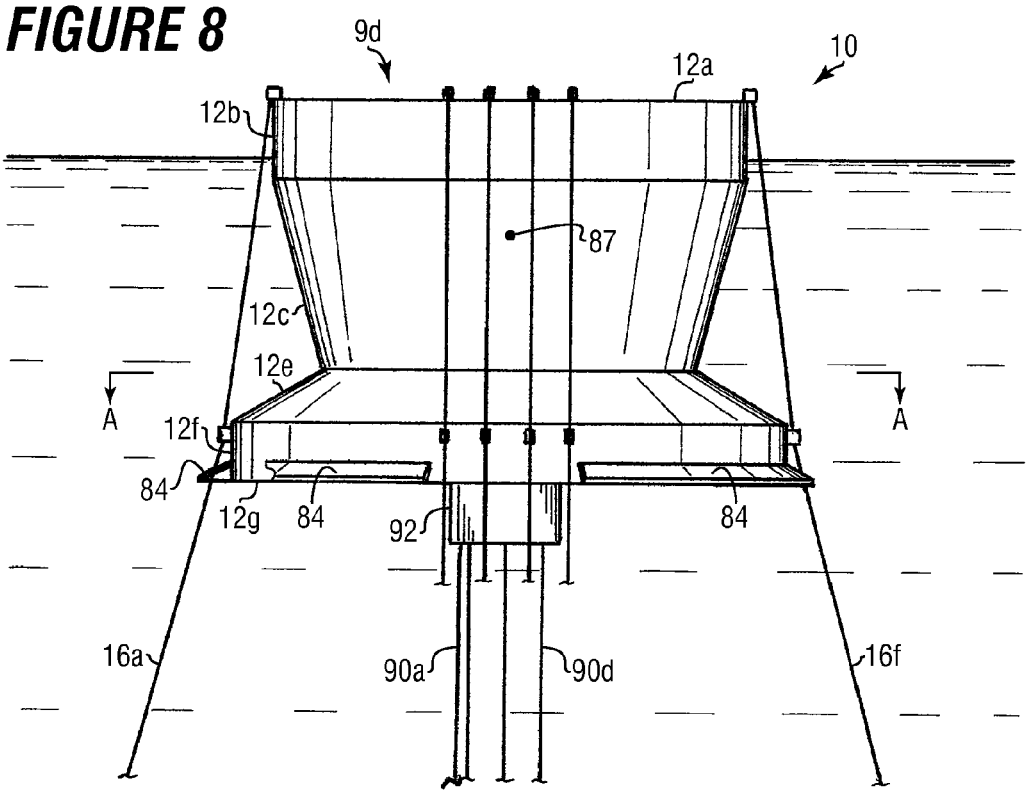
FIG. 8 depicts a side elevation of a floating production, storage and offloading vessel, according to the present invention.

FIG. 8 depicts a side elevation of the floating, production, storage and offloading vessel 10 according to the present invention.

The floating production, storage and offloading vessel 10 can have the hull 9*d* and the top deck surface 12*a* and a cross-section of the hull 9*d*, through any horizontal plane, while the hull 9*d* can be floating, can be a circular shape.

The upper cylindrical portion 12*b* extends downwardly from the top deck surface 12*a* and the upper conical section 12*c* extends downwardly from the upper cylindrical portion 12*b* and tapers the floating production, storage and offloading vessel 10. The lower conical section 12*e* extends downwardly from the upper conical section 12*c* and can flare outwardly. The lower cylindrical section 12*f* can extend downwardly from the lower conical section 12*e*. The hull 9*d* can have the bottom surface 12*g*, also known as a keel. The lower conical section 12*e* can be described herein as having the shape of an inverted cone or as having an inverted conical shape as opposed to the upper conical section 12*c*, which can be described herein as having a regular conical shape.

In this embodiment, the floating production, storage and offloading vessel 10 is shown as floating, such that the surface of the water can intersect the upper cylindrical portion 12*b* when loaded and/or ballasted. In this embodiment, the upper conical section 12*c* can have a substantially greater vertical height than the lower conical section 12*e*, and the upper cylindrical portion 12*b* can have a slightly greater vertical height than the lower cylindrical section 12*f*.

In this embodiment, for reducing heave and otherwise steadying the floating production, storage and offloading vessel 10, at least one fin 84 can be attached to a lower and outer portion of the hull.

In this embodiment, a low center of gravity 87 that provides an inherent stability to the floating production, storage and offloading vessel 10 is depicted.

The at least one anchor lines 16*a* and 16*f* are shown for mooring the floating production, storage and offloading vessel 10.

A moon pool 92 is shown formed in the center of the hull 9*d* and extending through the bottom surface 12*g*.

Catenary production risers 90*a* and 90*d* are also shown.

Figure 9:
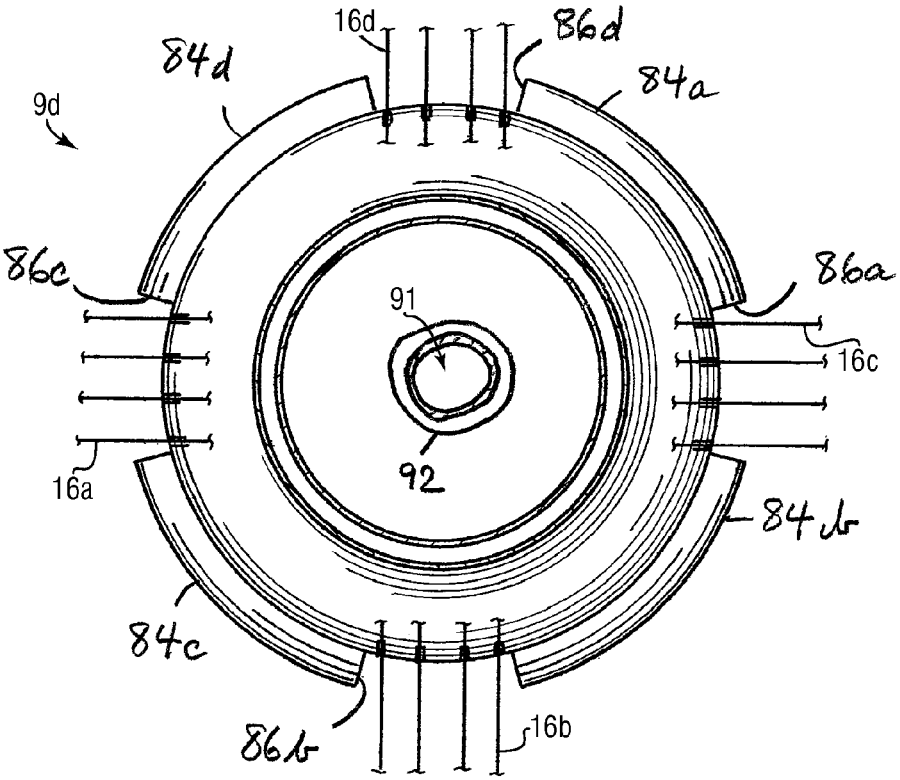
FIG. 9 depicts a cross section of the floating production, storage and offloading vessel as seen along the line 16-16.

FIG. 9 depicts a cross-section of the floating production, storage and offloading vessel with the hull 9*d*.

The hull 9*d* can have at least one fin. In this embodiment, a plurality of fins 84*a*, 84*b*, 84*c* and 84*d* are shown. When using a plurality of fins 84*a*, 84*b*, 84*c*, and 84*d*, the plurality of fins can be separated from each other by a plurality of gaps 86*a*, 86*b*, 86*c* and 86*d*. The plurality of gaps 86*a*, 86*b*, 86*c* and 86*d* can be spaced between the plurality of fins 84*a*, 84*b*, 84*c* and 84*d*, which can provide a place that accommodates the at least one catenary production risers, such as production risers and anchor lines on the exterior of the hull 9*d*, without contact with the at least one fin 84*a*, 84*b*, 84*c*, and 84*d*.

At least one anchor line 16*a*, 16*b*, 16*c* and 16*d* can be received in the plurality of the gaps 86*a*, 86*b*, 86*c* and 86*d* respectively. The at least one anchor line secures the floating drilling, production, storage and offloading vessel and/or the floating production, storage and offloading vessel 10 to the seabed. Catenary production risers can be received in the plurality of gaps 86*a*, 86*b*, 86*c*, and 86*d* and can deliver a resource, such as crude oil, natural gas and/or a leached mineral, from the Earth below the seabed to tankage within the floating production, storage and offloading vessel 10.

The moon pool 92 is also depicted with an opening 91 to the bottom surface.

Figure 10:
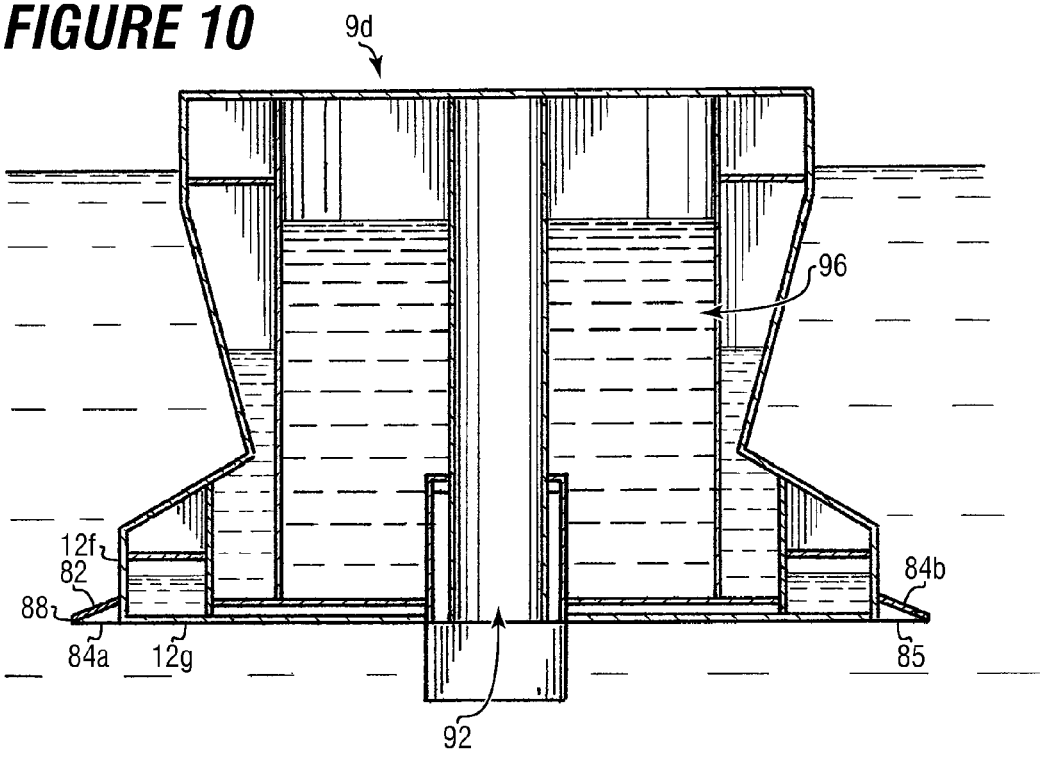
FIG. 10 depicts the side elevation of the floating production, storage and offloading vessel shown in cross section.

FIG. 10 depicts the at least one fin 84*a* and 84*b* for reducing heave.

Each section of the at least one fin 84*a* and 84*b* can have the shape of a right triangle in a vertical cross-section, where the 90 degree angle can be located adjacent a lowermost outer side wall of the lower cylindrical section 12*f* of any of the hulls, shown here as hull 9*d*, such that a bottom edge 85 of the triangle shape of the at least one fin 84*a* and 84*b* is co-planar with the bottom surface 12*g* of the hull 9*d*.

A hypotenuse 82 of the triangle shape extends from a distal end 88 of the bottom edge 85 of the triangle shape upwards and inwards to attach to the outer side wall of the lower cylindrical section 12*f* at a point only slightly higher than the lowermost edge of the outer side wall of lower cylindrical section 12*f*. Some experimentation can be required to size the at least one fin 84*a* and 84*b* for optimum effectiveness. As one example, a starting point can be the bottom edge 85 extending radially outwardly a distance that can be about half the vertical height of lower cylindrical section 12*f*, and the hypotenuse 82 attaches to the lower cylindrical section 12*f* such as, about one quarter up the vertical height of the lower cylindrical section 12*f* from the bottom surface 12*g* of the hull or combinations thereof.

The orientation of each triangle shape fin can be rotated by 45 degrees and attached to the hull and be usable herein.

After the floating production, storage and offloading vessel can be anchored and its installation can be otherwise complete, it can be used for drilling exploratory or production wells, provided a derrick is installed, and it can be used for production and storage of resource or products.

At least one ballast tank 96 is depicted for ballasting and deballasting the floating production, storage and offloading vessel 10 as well as the moon pool 92.

Figure 11:
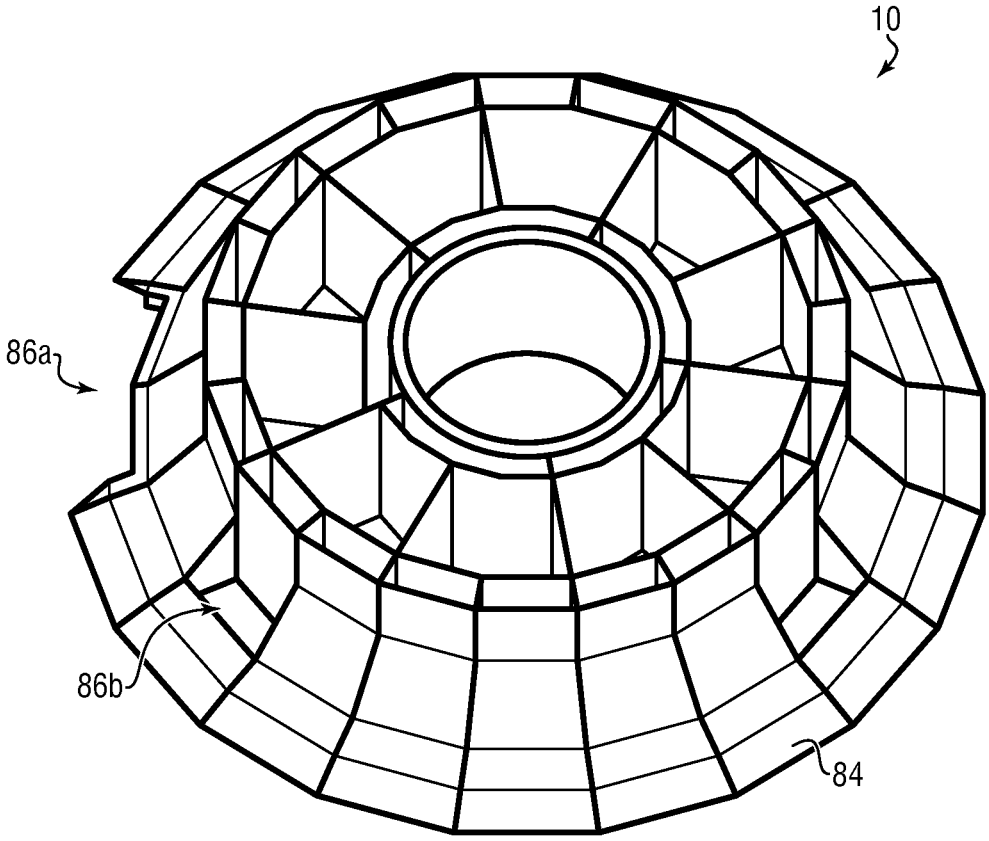
FIG. 11 depicts a detail view of a fin secured to a hull according to the floating production, storage and offloading for the purpose of providing hydrodynamic performance through linear and quadratic damping.

FIG. 11 provides a perspective detailed view of the floating production, storage and offloading vessel 10 with a detail of the at least one fin 84 attached to and transitioned from one of the aforementioned hull configurations.

The plurality of gaps 86*a* and 86*b* are shown separating the at least one fin 84.

It should be noted that this hull design with the submerged section of the hull having the at least one fin and a heavier or larger lower cylindrical section can create the hull that provides for improved hydrodynamic performance through linear and quadratic damping, namely suppression of radiated waves and friction of viscous origin while that portion of the hull is submerged.

In an embodiment, the vessel can have an ellipsoidal planform, the dynamic response of the hull can be independent of wave direction (when neglecting any asymmetries in the mooring system, risers, and underwater appendages), thereby minimizing wave-induced yaw forces. When the vessel has a conical form of the hull, the hull can be structurally efficient, offering a high payload and storage volume per ton of steel when compared to traditional ship-shaped offshore structures.

In embodiments, the hull can have ellipsoidal walls which can be ellipsoidal in radial cross-section, but such shape may be approximated using a large number of flat metal plates rather than bending plates into a desired curvature. A polygonal hull planform can be used according to alternative embodiments.

In embodiments, an elliptical hull can minimize or eliminate wave interference.

In further embodiments, the floating production, storage and offloading vessel can be configured to support at least one of: drilling of wells, work over of wells, production, storage of hydrocarbons, and personnel accommodation.

In embodiments, the floating production, storage and offloading vessel can have the hull with a hull planform that can be circular, oval, elliptical, or polygonal.

In embodiments, the hull can have the bottom surface and the deck surface.

In embodiments, the hull can be formed using at least two connected sections engaging between the bottom surface and the deck surface.

In embodiments, the at least two connected sections can be joined in series and symmetrically configured about a vertical axis with the connected sections extending downwardly from the deck surface toward the bottom surface.

In further embodiments, the connected sections can be at least two of: the upper cylindrical portion; the neck section; and the lower conical section.

In embodiments, the at least one fin can be secured to the hull and extend from an outer side of the hull.

In embodiments, the hull can be configured so that the lower conical section provides added mass improved hydrodynamic performance through linear and quadratic damping to the hull and wherein the floating production, storage and offloading vessel does not require a retractable center column to control pitch roll and heave.

In embodiments, the floating production, storage and offloading vessel can have a centrally disposed moon pool. The moon pool can open through the bottom surface.

In embodiments, the floating production, storage and offloading vessel can have the at least one anchor line extending from the deck surface or the hull to moor the floating production, storage and offloading vessel to the sea floor.

In embodiments, the floating production, storage and offloading vessel can have the at least one fin discontinuously secured around the hull on the outer surface of the hull.

In embodiments, the floating production, storage and offloading vessel can have the at least one catenary production riser or at the least one vertical riser secured to the bottom surface below a transit depth of the floating production, storage and offloading vessel.

In embodiments, the floating production, storage and offloading vessel can have the at least one ballast tank for ballasting and deballasting the floating production, storage and offloading vessel.

In embodiments, the floating production, storage and offloading vessel can have the movable hawser connection assembly mounted to the hull.

The floating production, storage and offloading vessel in embodiments can have the low center of gravity providing an inherent stability to the structure.

While these embodiments have been described with emphasis on the embodiments, it should be understood that within the scope of the appended claims, the embodiments might be practiced other than as specifically described herein.

What is claimed is:

1. A floating production, storage and offloading vessel configured to support at least one of: a drilling of well, a workover of well, a production and storage of hydrocarbon, and a personnel accommodation, the floating production, storage and offloading vessel comprising:

a. a hull with a hull planform that is circular, oval, elliptical, or polygonal, wherein the hull comprises:
   (i) a bottom surface;
   (ii) a top deck surface; and
   (iii) at least two connected sections engaging between the bottom surface and the top deck surface, the at least two connected sections joined in series and symmetric configured about a vertical axis with the at least two connected sections extending downwardly from the top deck surface toward the bottom surface, the at least two connected sections comprising at least two of:
      1. an upper cylindrical portion;
      2. a cylindrical neck section; and
      3. a lower conical section; and b. at least one radial fin secured to the hull configured to provide hydrodynamic performance through linear and quadratic damping, the at least one radial fin having a shape of a right triangle in a vertical cross section such that a bottom edge of the right triangle is coplanar with the bottom surface of the hull;

wherein the lower conical section provides added mass improved hydrodynamic performance through linear and quadratic damping to the hull, and wherein the floating production, storage and offloading vessel does not require a retractable center column to control pitch, roll and heave.

2. The floating production, storage and offloading vessel of claim 1, further comprising a moon pool, wherein the moon pool opens through the bottom surface.

3. The floating production, storage and offloading vessel of claim 1, wherein the hull further comprises a low center of gravity providing an inherent stability to the floating production, storage and offloading vessel.

4. The floating production, storage and offloading vessel of claim 1, comprising at least one anchor line to moor the floating production, storage and offloading vessel to a sea floor.

5. The floating production, storage and offloading vessel of claim 1, wherein the at least one radial fin is discontinuously secured around the hull.

6. The floating production, storage and offloading vessel of claim 1, comprising at least one catenary production riser secured to the bottom surface below a transit depth of the floating production, storage and offloading vessel.

7. The floating production, storage and offloading vessel of claim 1, comprising at least one ballast tank for ballasting and deballasting the floating production, storage and offloading vessel.

8. The floating production, storage and offloading vessel of claim 1, comprising a moveable hawser connection assembly mounted to the hull.

* * * * *